United States Patent [19]

Hood

[11] 4,019,940

[45] Apr. 26, 1977

[54] METHOD OF MANUFACTURING PARALLEL YARN ROPE

[75] Inventor: Henry Alexander Hood, Moorestown, N.J.

[73] Assignee: Wall Industries, Inc., Beverly, N.J.

[22] Filed: July 25, 1975

[21] Appl. No.: 599,108

Related U.S. Application Data

[62] Division of Ser. No. 434,627, Jan. 18, 1974, Pat. No. 3,911,785.

[52] U.S. Cl. ..... 156/148; 87/8; 118/6; 118/420; 156/180; 156/195; 156/296; 156/361; 427/175

[51] Int. Cl.[2] ..... B32B 5/08

[58] Field of Search ..... 87/1, 7, 8; 156/148, 156/166, 180, 296, 195, 361, 64; 427/175; 226/44; 118/6, 420

[56] References Cited

UNITED STATES PATENTS

| | | | |
|---|---|---|---|
| 2,146,275 | 2/1939 | Thompson | 173/264 |
| 2,298,748 | 10/1942 | Brown | 87/1 |
| 2,419,922 | 4/1947 | Tippetts | 427/175 |
| 2,590,586 | 3/1952 | Thompson et al. | 427/175 |
| 2,844,487 | 7/1958 | Waller et al. | 427/175 |
| 3,235,932 | 2/1966 | Jones | 26/18.5 |
| 3,413,186 | 11/1968 | Marzocchi | 156/148 |
| 3,508,990 | 4/1970 | Marzocchi | 156/180 |
| 3,695,064 | 10/1972 | Runton | 26/18.5 |
| 3,785,902 | 1/1974 | Preston et al. | 156/361 |
| 3,850,658 | 11/1974 | Gomez et al. | 427/175 |
| 3,908,042 | 9/1975 | Heissler et al. | 118/6 |

*Primary Examiner*—Edward G. Whitby
*Attorney, Agent, or Firm*—Stanley B. Kita

[57] ABSTRACT

A high-strength parallel yarn rope comprises a series of multi-filament rope yarns which are bounded together in parallel relation along their lengths by a binder distributed only on the surfaces of the yarns to form a flexible rope core. The core is surrounded by a braided jacket, and a flexible layer of water-impervious material adhesively and mechanically bonds the core to the jacket.

A method is also disclosed for manufacturing the rope.

14 Claims, 6 Drawing Figures

METHOD OF MANUFACTURING PARALLEL YARN ROPE

This is a division of application Ser. No. 434,627 filed Jan. 18, 1974, now U.S. Pat. No. 3,911,785.

The present invention relates to rope, and more particularly, the present invention relates to parallel yarn ropes and methods of manufacturing the same.

A conventional parallel yarn rope has a series of rope yarns which extend in parallel relation inside a protective jacket. An ordinary braided or twisted rope, on the other hand, has a series of yarns which are disposed at angles with respect to the longitudinal axis of the rope. It is known that braided or twisted yarn ropes are not as strong as parallel yarn ropes because the angularly disposed yarns must accept a greater tensile load for a given rope lead than would be required if the yarns were disposed parallel to the axis of the rope, as in a parallel yarn rope. Thus, parallel yarn ropes are considerably stronger than braided or twisted ropes of the same construction materials and weight per unit length.

An example of a parallel yarn rope or cable is disclosed in U.S. Pat. No. 3,265,805. The patented rope comprises a core made up of a series of parallel multifilament yarns which are bonded together by a elstomeric material. A braided sheath surrounds the core and is bonded thereto by a layer of elastomeric material. In addition, this patent discloses a method for making the rope.

Although the rope disclosed in the aforementioned patent has been found satisfactory for many applications, it has certain limitations. For instance, although the rope is relatively strong, it has a limited amount of flexibility. The limited flexibility is believed to be due to the impregnation of the yarns by the elastomer binder during the manufacturing process. The impregnation causes interior filaments to bond together, thereby rendering each yarn relatively stiff. It has been determined that the stiffness of the yarns contributes to a weakening of the inter-yarn bond after the rope is flexed a number of times, such as by rolling and unrolling the rope around pulleys or from a spool while in service. Moreover, the lack of flexibility tends to weaken the bond between the core and the jacket, and such weakening may cause the jacket to separate from the core in use. Needless to say, a rope which is of limited flexibility and in which the inter-yarn and core-jacket bond strengths may weaken is not as desirable as one which is highly flexible and which retains its bond strength even after prolonged use.

It is known that a parallel yarn rope exhibits its greatest strength when each rope yarn accepts the same tensile load. For instance, a lack of uniformity in the tension on the yarns as manufactured can cause the yarn under the greatest tension to fail when the rope is loaded. This can have the effect of accelerating total failure of the rope since the other yarns must then be required to accept even more tensile stress than they were designed to accept. Accordingly, it is highly desirable for a parallel yarn rope to be manufactured by a process which ensures substantial uniformity in tension among the various rope yarns.

A parallel yarn rope having a structure similar to that disclosed in the aforementioned patent finds particular utility as a pulling rope in stringing electrical power lines, because the rope has a high strength/diameter ratio and a minimum of elongation under tension. It has been found, however, that moisture penetrates deep into the interior of the patented prior art rope when it becomes wet, and because of this, the rope is relatively slow to dry. If the rope is to be used safely in a linepulling operation, it must be kept out of service for a prolonged period of time since even a small amount of moisture contained in the interior of the rope may be sufficient to permit the rope to conduct electricity if the rope were to fall onto an energized high-tension power line while in use. The flow of electricity through the rope could sever the rope, or at least greatly weaken it. Moreover, the ability of the rope to conduct electricity when wet presents a safety hazard to workmen engaged in the line stringing operation.

With the foregoing in mind, it is a primary object of the present invention to provide a strong and flexible parallel yarn rope which retains its inter-yarn and core to jacket bond even after prolonged usage.

It is another object of the present invention to provide a parallel yarn rope which has improved dielectric strength.

It is still another object of the present invention to provide an improved method for manufacturing a parallel yarn rope.

As a further object, the present invention provides a method of manufacturing a parallel yarn rope wherein multifilament rope yarns are bonded together in such a manner that interior filaments in the yarns are substantially free from binder, whereby the resulting rope is highly flexible.

The present invention also provides, as an object, a novel method for accurately controlling the tension on rope yarns during the process of manufacturing a parallel yarn rope in order to insure uniformity of tension among the yarns, to prevent the binder from impregnating the yarns, and to enable the rope to be manufactured with yarns which have not been previously treated to prevent shrinkage during rope manufacture.

More specifically, the present invention provides a parallel yarn rope which comprises a core made up of a series of multi-filament parallel yarns bonded together along their lengths by a binder which is distributed on the surfaces of the yarns so that filaments in the interior of the yarns are free from binder. A layer of water-impervious electrical insulating material surrounds the core, and the insulating layer in turn is surrounded by a braided outer jacket which is also coated with a similar material. The braided jacket has a series of internal recesses disposed transversely to the core, and the layer of insulating material has rib portions which project radially into the recesses to mechanically interlock the layer and the jacket and to adhesively bond the jacket to the core. Preferably the binder and insulating materials have adhesive and elastic properties such as neoprene, and preferred yarn materials include high strength, continuous filament, synthetic materials such as nylon, glass, polyester, and Kevlar (temporarily designated DP-01 by the Federal Trade Commision).

In manufacturing the rope of the present invention, slightly twisted rope yarns are advanced lengthwise in parallel relation, and a controlled amount of tension is applied to the yarns as they advance in order to compact the yarn filaments. The yarns are coated with neoprene binder while under tension to ensure distribution of the neoprene only on the surfaces of each yarn. Thereafter, the yarns are completely dried at a temperature below the curing temperature of neoprene, and the yarns are rendered tacky before being joined together lengthwise to form a core. A layer of uncured neoprene tape is wrapped around the core, and a jacket is thereafter braided around the wrapped core. A coating of neoprene is applied to the surface of the jacket; the neoprene coating is dried; and the rope assembly is thereafter heated to cure all the neoprene. After heating, the rope assembly is permitted to cool to ambient temperatures while under tension before being wrapped onto a spool. The temperature during the drying stage is maintained at about 225° F., and the temperature during the curing stage is maintained at about 325° F. In order to effect accurate control of the yarn tension during the entire process, the velocity of the rope is sensed in the curing step, the tension on the yarns upstream of the coating step is sensed, the sensed velocity and tension are converted into electrical signals, and the velocity of the yarns upstream of the coating step is regulated in response to changes in the signals.

These and other objects, features and advantages of the present invention should become apparent from the following description when taken in conjunction with the accompanying drawings, in which.

Figure 1:
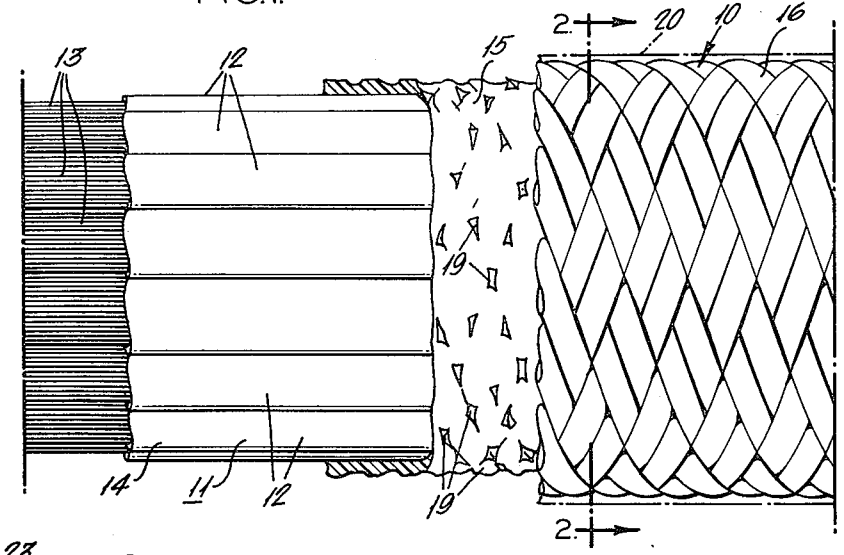
FIG. 1 is an enlarged side elevational view of a length of parallel yarn rope embodying the present invention, portions of the rope-jacket being broken away to expose a water impervious layer which surrounds a core made up of a series of parallel yarns each having a plurality of filaments.

Referring now to the drawings, there is illustrated in FIG. 1 a length of rope 10 which embodies the present invention. As seen therein, the rope 10 comprises a core 11 which is made up of a plurality of yarns 12, 12 which extend in substantially parallel relation for the full length of the rope 10. Each yarn 12 comprises a series of filaments, such as the filaments 13, 13, and the yarns 12, 12 are bonded together along their lengths by a binder material 14. The number of yarns 12, 12 which constitute the core 11 depends on a number of design factors such as the load the rope is designed to carry, etc. Also, the number of filaments 13, 13 in each yarn may vary. A typical rope is illustrated.

Figure 2:
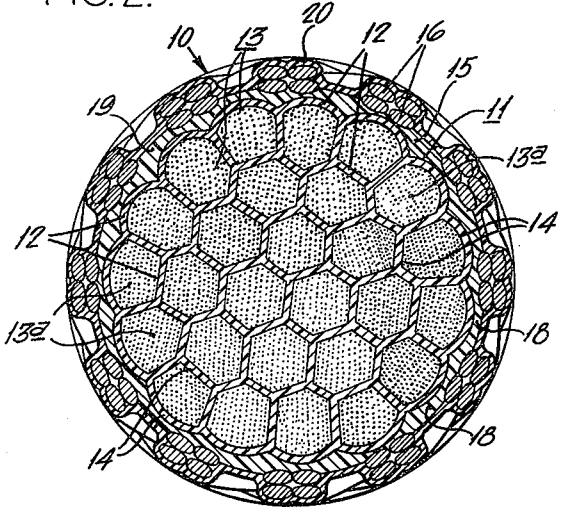
FIG. 2 is a sectional view taken along line 2—2 of FIG. 1.

As best seen in FIG. 2, the binder 14 is disposed predominantly on the surface of each yarn 12, so that minute interstices among the interior filaments 13, 13 are substantially free from the binder 14. A non-porous layer 15 of flexible water-impervious electrical insulating material surrounds the core 11, and a braided protective jacket or cover 16 surrounds the layer 15. An outer coating 20 of neoprene renders the rope resistant to abrasion and degradation by ultraviolet light.

In the illustrated embodiment, the filaments 13, 13 are continuous and preferably of man-made materials which have high tensile strength. Examples of such materials include glass, nylon, polyester and a relatively new material sold under the trade name Kevlar by the E. I. du Pont de Nemours Company of Wilmington, Del. (designated DP-01 by the Federal Trade Commission). Although certain preferred filament materials are set forth, it should be apparent that other filament materials having similar properties may be employed satisfactorily.

The binder 14 which joins the yarns 12, 12 together, and the layer 15 which surrounds the core 11, are preferably of a synthetic rubber material which is capable of effecting a strong adhesive bond between the yarns 12, 12 and between the core 11 and the jacket 16. An example of such a material which has been tested and found satisfactory is neoprene; however, other elastomeric materials having properties generally similar to neoprene such as flexibility, good adhesion, resistance to chemicals, etc. may provide adequate substitutes.

It is important for the jacket 16 to be firmly secured to the core 11 of the rope 10. In accordance with the present invention, the adhesive bond between the insulating layer 15 and the jacket 16 is augmented by a mechanical interaction which is designed to increase the shear resistance between the jacket 16 and the insulating layer 15. To this end, the jacket 16 has a series of shallow internal recesses between its yarns, such as the recesses 18, 18 (FIG. 2), and the insulating layer 15 has ribbed portions 19, 19 which project radially outward into the recesses 18, 18. As best seen in FIG. 1, the ribs 19, 19 are slightly elongated and are disposed transversely to the core 11. In ropes having outside diameters up to about ¾ inch, the layer 15 should be at least 10 mils thick, preferably about 20–25 mils thick; however, in ropes having diameters of ⅞ inch and greater, the layer 15 should be 30–35 mils thick. Thus, the thickness is in a range of about 25 to about 40 mils per inch of rope diameter. The thickness of the layer is important for several reasons. First, it ensures adequate material to provide water resistance. Secondly, it ensures adequate material to effect formation of the ribs 19, 19 during curing of the rope. Thirdly, it prevents the jacket from biting through to the core 11 during braiding. As a result, the jacket 16 is mechanically fastened to the insulating layer 15 as well as being adhesively secured thereto so that the jacket 16 resists longitudinal separation from the core under load.

As noted heretofore, the rope of the present invention finds particular utility in applications where abrasion and moisture resistance as well as flexibility and strength are desirable properties and wherein it is important for the rope to retain a significant amount of flexibility and bond strength even after prolonged use. It is believed that an important factor in the ability of the rope of the present invention to maintain these properties is due to the manner in which the binder 14 binds the yarns together. For instance, in the present invention, the binder 14 is neoprene and is distributed predominantly on the surfaces of the yarns so that the inner filaments 13*a*, 13*a* are free from binder. This permits the inner filaments 13*a*, 13*a* to slide longitudinally relative to one another as the rope is flexed and thereby renders the rope highly flexible. This is in contrast with the aforementioned patented rope wherein the binder is natural rubber and is distributed throughout the rope yarns.

In order to illustrate the importance of the binder material and its distribution, a length of the patented rope was subjected to a so-called flexural abrasion test, and a length of rope of the present invention was similarly tested. In this test, each rope was wound halfway around each of three pulleys (about six inches in diameter) spaced apart horizontally with the center pulley being at a higher level than the other two so that the rope took a generally sinusoidal shape around the pulleys. The ends of the rope were connected to a mechanism which pulled the rope in alternate directions around the pulleys to flex the rope. Both ropes had a diameter of ⅞ inch and were subjected to 500 pounds of tension during the test.

After the ropes were cycled in the flexural abrasion test apparatus, they were removed and the strength of the bond between the rope yarns were determined by measuring the tension required to separate one yarn from the other yarns in the core. This is effected by disposing a short length of the yarn at an acute angle with respect to the other yarns and pulling the yarn at that angle. The tension required to separate the yarn from others in the conventional parallel yarn rope as manufactured, i.e., before being subjected to the flexural abrasion test, was 6 pounds. The tension required to effect the same separation in the rope of the present invention as manufactured, was 4 pounds. After the convention parallel yarn rope was subjected to 150 cycles in the above apparatus, the strength of the bond among the yarns was measured and found to be ½ pound. The rope of the present invention, on the other hand, was tested after being subjected to 2,000 cycles in the above apparatus and was found to have retained substantially all of its interyarn bond strength. Furthermore, it was determined that the rope of the present invention retained substantially all of its core to jacket bond strength; whereas, the core to jacket bond strength of the patented rope was significantly reduced. Accordingly, it should be apparent that when parallel yarns in a rope core are bonded together by neoprene in such a manner that interior filaments making up the yarns are free from binder, the resulting rope is highly flexible and retains its flexibility and core coherence even after being subjected to a number of flexural cycles.

The ropes of the present invention has superior dielectric properties, as compared with prior art ropes, and the rope of the present invention retains its dielectric strength even after prolonged usage. As a result, the rope of the present invention finds particular utility in line pulling operations where dielectric strength is an important safety factor. In large measure, the dielectric strength is provided by the layer 15 of the non-porous dielectric adhesive tape which surrounds the core 11 under the protective jacket 16 and which functions to prevent moisture from penetrating the core 11. However, it is also important for the core 11 to be highly flexible in order to maintain the integrity of the layer 15. Preferably, such flexibility is achieved by binding the yarns together as described above in order to prevent the yarns from being stiff and tending to separate from one another after repeated flexure under load, separation of the yarns being undesirable because relative movement between separated relatively stiff yarns could cause the layer 15 to erode and permit moisture to penetrate the core 11.

The rope of the present invention was tested for dielectric strength and compared with the aforementioned patented prior art rope. In the test, a length of each rope (⅞ inch in diameter) was immersed in water for 1 week with its ends out of water. The lengths were removed, and a voltage was applied across a one foot segment of each rope by contacts engaging the outsides of the rope-jackets. As a measure of dielectric strength, the voltage required to cause 1 ma. of current to flow through each rope was determined, and it was observed that immediately upon removal, each rope passed 1 ma. of current when 300 volts was applied. The ropes were thereafter heated to 250° F for 1 hour in a hot air oven (to accelerate and similate air drying) and they were again tested. In the prior art rope, 1 ma. of current flowed when approximately 2,000 volts was applied; however, the same amount of current flowed through the rope of the present invention only when the applied voltage exceeded 10,000 volts. This test demonstrates the ability of the rope of the present invention to dry relatively rapidly after becoming wet, as compared with the relatively slow-drying proclivity of the prior art rope.

In another test, the jacket of each rope was electrically connected to the rope core by a pin extending diametrically through each end of the one foot rope segment. After being dried as above, voltage was applied to the pins. The prior art rope conducted 1 ma. of current when only 400 volts was applied across the pins; however, the rope of the present invention conducted the same amount of current only when more than 10,000 volts was applied across the pins. The wide difference in voltage indicated that moisture penetrated deep into the core of the prior art rope and did not dry during heating, but the moisture did not penetrate into the core of the rope of the present invention.

In order to demonstrate the ability of the rope of the present invention to retain its dielectric strength even after prolonged usage, a length was tested for dielectric strength before and after being subjected to the flexural abrasion test noted above, and it was observed that the dielectric strength of the rope was the same before and after the flexural abrasion. A comparison with the prior art rope was not made, however, because of the failure of the prior art rope to endure the flexural abrasion test.

The rope of the present invention is manufactured economically by a novel process. To this end, the rope yarns are tensioned during the entire manufacturing process to limit the proclivity of the man-made yarns to shrink when heated, to ensure the distribution of binder material only on the surfaces of the rope yarns, and to ensure uniform tension among the rope yarns. Thus, relatively low-cost yarns, which are not treated to prevent shrinkage, may be utilized to produce the strong and highly-flexible rope of the present invention.

In practicing the method of the present invention, certain standard pieces of rope manufacturing equipment are employed. However, the equipment is interconnected by a control system which functions to effect accurate control of the yarn tension during the entire process. The equipment and control system employed in the process are illustrated schematically in FIGS. 3A and 3B, with the equipment used in the initial stage of the manufacturing process being illustrated in FIG. 3A.

Figure 4:
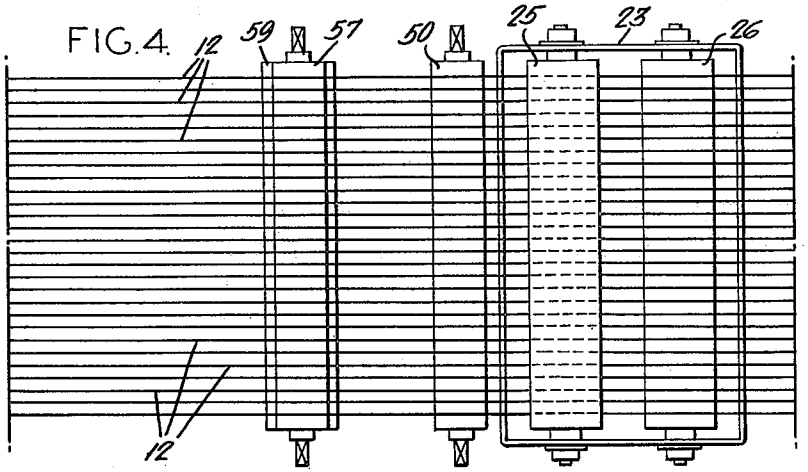
FIG. 4 is a plan view taken along lines 4—4 of FIG. 3A.
Figures 3A, 3B:
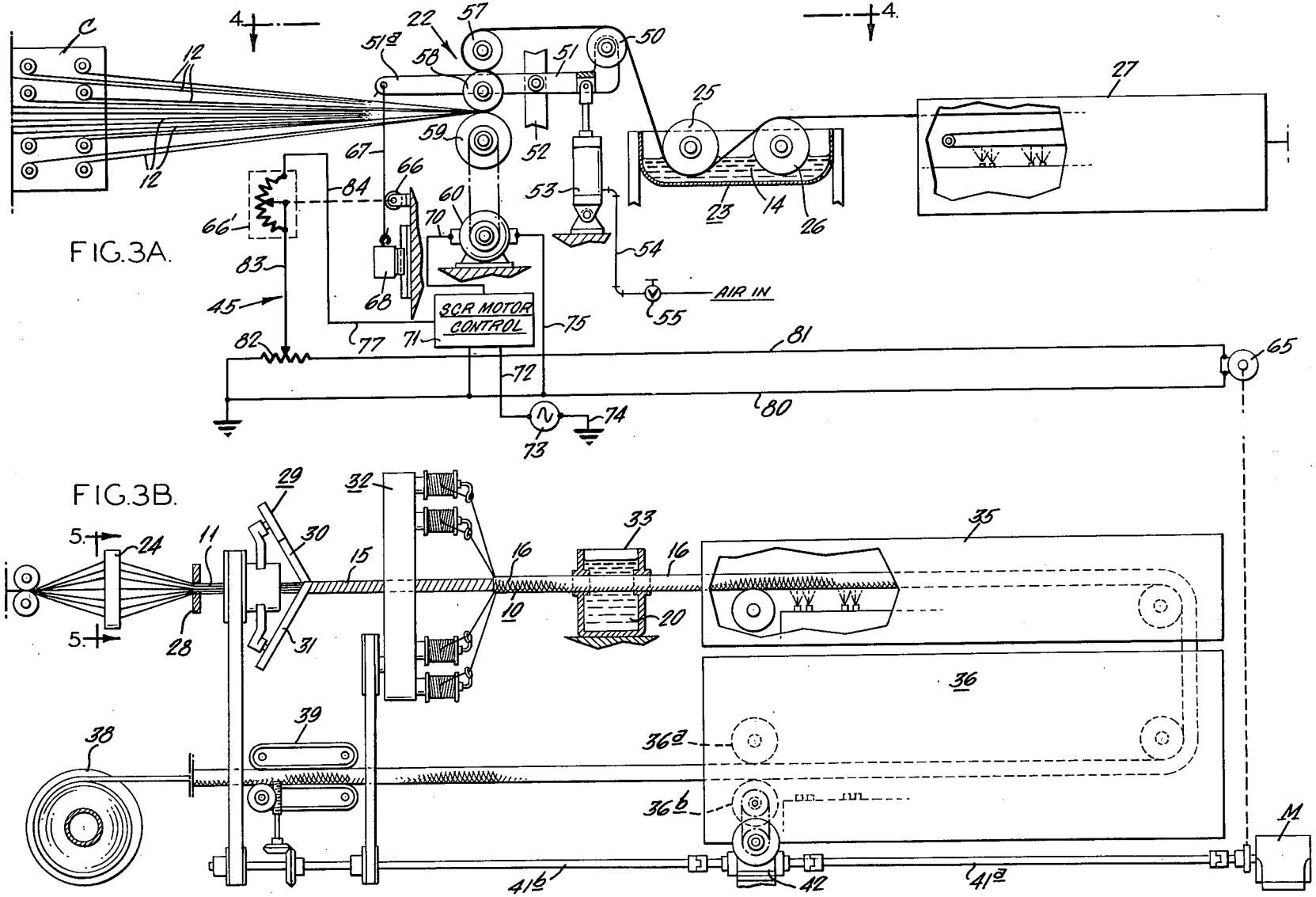
FIGS. 3A and 3B are schematic diagrams illustrating a method of manufacturing the rope illustrated in FIG. 1.

As best seen at the upper lefthand corner in FIG. 3A, a series of rope yarns 12, 12 advance rightward from a like series of bobbins mounted in a creel C. Each yarn comprises a series of twisted filaments 13, 13, and each rope yarn 12 has a slight twist of about 4–8 t.p.f. which renders the yarn coherent. As may be seen in FIG. 4, the yarns 12, 12 advance in parallel relation in a horizontal plane through the entire first phase of rope manufacture illustrated in FIG. 3A which includes yarn coating and drying steps.

The yarns are tensioned while being coated. For this purpose, the yarns 12, 12 advance through tension control apparatus indicated generally at 22, and the tension control apparatus 22 is located ahead of a vat 23 containing the binder 14. The binder 14 is a neoprene latex containing about 20%, by weight, of uncured neoprene. The yarns 12, 12 are coated with the binder 14 as they advance through the vat 23 under a roller 25 and over a roller 26, with the yarns 12, 12 inclining under tension between the rollers. The tension on the yarns during coating prevents the binder 14 from impregnating the yarns so that the inner filaments 13*a*, 13*a* are free from binder 14.

After the yarns 12, 12 are coated with the binder 14, they advance into an oven 27 wherein they are heated and completely dried, but not cured. The temperature of the air in the oven 27 is maintained at about 225° F., and the yarns 12, 12 are heated for a sufficient period of time to dry the coating. The uncured but dry neoprene is also rendered tacky. The time period, of course, depends on a number of factors such as yarn velocity, thickness of the coating, etc. In practice, it is desirable for the yarns 12, 12 to be heated for about 15 minutes ± 5 minutes to ensure satisfactory results.

Figure 5:
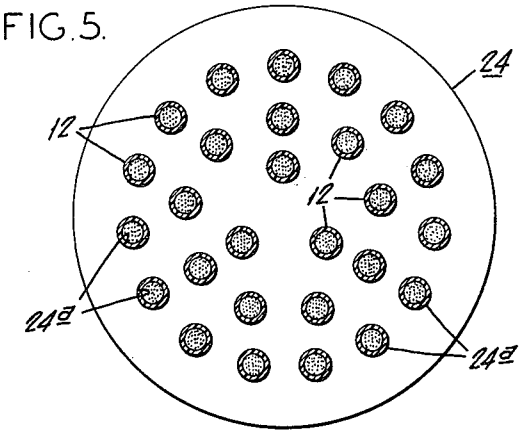
FIG. 5 is an enlarged sectional view taken along lines 5—5 of FIG. 3B.

The coated yarns 12, 12 exiting from the oven 27 are joined together lengthwise to form the coherent core 11 in the second stage of the manufacturing process illustrated in FIG. 3B. For this purpose, the yarns 12, 12 are advanced through a reeve plate 24 which, as best seen in FIG. 5, has a series of apertures 24*a*, 24*a* spaced apart in concentric circles to arrange the yarns 12, 12 in a predetermined pattern so that, in the finished rope, the yarns assume the pattern illustrated in FIG. 2. The yarns are thereafter advanced through a die 28 which conjoins the yarns lengthwise into a compact cylindrical bundle or core 11. Because the neoprene coating is tacky, the yarns 12, 12 stick together downstream of the die 28.

The core 11 thereafter advances through a tape server 29 which functions to wrap one or more layers of uncured neoprene tape helically about the core. In the illustrated process, the server 29 wraps two tapes 30 and 31 around the core, with one tape overlapping the other slightly. It should be understood, however, that three, four or more tapes may be applied, depending on the desired thickness of the neoprene layer. In the alternative, the rotational velocity of the server may be increased to enable a relatively thick layer to be applied even with a single tape. Since the layer 15 is provided by a tape, it is non-porous and hence highly impervious to water.

After the core 11 is wrapped with tape, it advances through a braiding machine 32. The braiding machine braids the protective jacket 16 tightly around the wrapped core 11 to form the rope assembly 10. The rope assembly 10 then advances through a tank 33 containing another quantity of neoprene 20 which provides the coating of neoprene 20 on the outside of the jacket 16. Preferably, the neoprene latex in the tank 33 contains 30% by weight of neoprene.

The rope assembly 10 then advances into a second heating oven 35 to dry the coating 20. The temperature in the oven is maintained at about 225° F., in a range between about 215° F. and 250° F. The duration of drying is about 10 minutes.

After the coating 20 is dried, the neoprene binder 14, the neoprene tapes 30 and 31, and the neoprene coating 20 are cured. For this purpose, the rope assembly 10 advances through another oven 36, the temperature of which is maintained at about 325° F. ±25° F. Preferably, the rope is cured for a period of about 20 minutes, ranging between 15 and 45 minutes, depending on the diameter of the rope with larger diameter ropes requiring more time to cure.

In order both to advance the rope 10 and tension the same downstream of the coating vat 23, the rope advances between a pair of rollers 36*a* and 36*b* disposed horizontally in the oven 36. The lower roller 36*b* is driven by a speed reducer 42 which is connected to a motor M. Although the tension rollers 36*a* and 36*b* are illustrated inside the oven 36, they may be located outside and downstream of the oven, if desired.

The rope assembly 10 is permitted to cool under tension after the curing step before being wound onto a spool 38. For this purpose, a caterpiller mechanism 39 grips the rope 10 and pulls it lengthwise to tension the rope 10 as it cools. Preferably, the rope is permitted to cool for up to 45 minutes before being wound onto the spool 38.

The speeds of the tape server 29, the braider 32, the oven rollers 36*a* and 36*b*, and the caterpiller mechanism 39 are synchronized with one another and with the speed of the motor M. For this purpose, a shaft 41*a* connects the speed reducer 42 to the motor M, and the tape wrapper 29, the braider 32 and the caterpiller tensioning mechanism 39 are driven by conventional belt or chain drive arrangements from a line shaft 41*b* which is connected to the speed reducer 42. Thus, when the motor M is energized, the rope 10, and hence its yarns 12, 12 are tensioned and advanced lengthwise at a velocity which is synchronized with the operating speeds of the various pieces of equipment.

In order to effect accurate control of the tension on the yarns 12, 12, the tensioning apparatus 22 cooperates with the motor M to provide both a coarse adjustment of the tension and an automatic fine adjustment thereof. To this end, the coarse tension adjustment is provided by controlling the velocity of the yarns 12, 12 upstream of the coating vat 23. For this purpose, a pair of idler rollers 57 and 58 are mounted in a frame 52 for rotation about parallel horizontal axes. The rollers 57 and 58 are stacked vertically so that the yarns 12, 12 pass between the roller 57 and 58, halfway around each. The lower roller 58 is driven by a friction roller 59 which, in turn, is driven by a variable speed D.C. motor 60. The speed of the motor 60, and hence the longitudinal velocity of the yarns 12, 12 upstream of the vat 23, may therefore be adjusted by regulating the speed of the motor 60 in relation to the speed of the speed of the rollers 36*a* and 36*b*. The fine tension adjustment is provided by a dancer roll 50 which engages the undersides of the yarns 12, 12 adjacent the coating vat 23 upstream thereof. The dancer roll 50 is mounted for rotation about a horizontal axis by a pair of arms pivotally mounted to the frame 52, such as the arm 51. An air cylinder 53 is connected to the underside of each arm for urging the dancer roll 50 upwardly into engagement with the yarns 12, 12. The air cylinder 53 is pressurized by compressed air which is supplied to the cylinder by a line 54 in which an adjustable pressure regulator 55 is connected. The regulator 55 may be adjusted to vary the tension on the yarns.

The tension on the rope yarns is adjusted automatically. To this end, the longitudinal velocity of the yarns 12, 12 is sensed in the curing oven 36, the tension on the yarns 12, 12 upstream of the coating vat 23 is sensed, and the sensed velocity and tension are converted into electrical signals for regulating the speed of the motor 60.

The longitudinal velocity of the rope 10, and hence the rope yarns 12, 12 therein, is sensed by the roller 36*b*, the rotational velocity of which is directly related to the speed of the rope 10 in the curing oven 36. Since the roller 36*b* is driven by the drive motor M, the speed of the motor is related to the velocity of the rope 10. In the present instance, the speed of the motor M is sensed and converted into an electrical signal by a D.C. generator 65. The generator 65 is mechanically connected to the motor M and produces a voltage which is proportional to the speed of the motor M, and the generator 65 is electrically coupled to the variable speed motor 60 by a circuit 45.

The tension on the yarns 12, 12 is sensed by the dancer roll 50 and is converted into an electrical signal by a rotary variable resistor or potentiometer 66 which is mounted to the frame 52 and which rotates in conjunction with movement of the dancer roll 50. In the illustrated process, the dancer roll arm 51 has an extension 51*a* on the other side of its fulcrum, and a cable 67 is connected to the end of the extension 51*a*. The cable wraps around the shaft of the resistor 66, and a weight 68 is hung from the cable 67 to tension the same for ensuring rotation of the resistor shaft in conjunction with motion of the dancer roll arm 51. The resistor 66 is connected in the circuit 45, and is indicated schematically as 66′ therein. Thus, a change in the linear velocity of the rope is converted into a proportional change in the D.C. voltage signal produced by the generator 65, and a change in the tension in the yarns 12, 12 is converted into a proportional change in the resistivity of the resistor 66.

The speed of the motor 60 is regulated by a solid-state controller. To this end, the armature of the motor 60 is connected through a line 70 to a conventional motor controller 71 which in turn is connected through a line 72 to a source of alternating current 73. The motor controller 71 is grounded by a line 74, and the armature of the motor 60 is also grounded by a line 75. The motor controller 71 is internally constructed to provide a regenerating function. That is, the controller 71 is not only capable of supplying current to the armature of the motor 60 to rotate the armature in one direction, but it is also capable of providing a dynamic braking action on the armature by causing to flow in a reverse direction through the armature 60. Since the internal construction of the motor controller 71 is conventional, further description is not believed necessary at this juncture; however, it is important to note that the ability of the motor controller 71 to power the motor 60 or to brake the same is dependent upon the magnitude of the D.C. signal supplied to the controller 71 through an input line 77.

The magnitude of the electrical signal fed into the input 77 of the motor controller 71 is a function of the D.C. voltage produced by the generator 65, as modified by the resistivity provided by the resistor 66. In order to adjust the sensitivity of the control system, however, a variable resistor 82 is connected in the circuit 45. As best seen in FIG. 3A, the generator 65 is grounded by a lead 80 and is connected by a lead 81 to the variable resistor 82. The resistor 82 has a tap 83 which is connected to the tension-sensing resistor 66′ in such a manner that an increase in the yarn tension causes a decrease in the resistivity of the resistor 66′, and vice versa. The input 77 to the motor controller 71 is connected to the variable resistor 66′. The variable resistor 82 permits the relative effect of the generator 65 and the resistor 66′ in the circuit 45 to be adjusted so that the desired tension control may be effected while minimizing vertical oscillation of the dancer roll 50.

The system is preset so that the speed of the rope in the curing oven 36 corresponds substantially to the speed of the yarns 12, 12 in the tensioning apparatus 22 for applying a predetermined tension to the yarns. The fine tension adjustment is effected by varying the air pressure regulator 55 to position the dancer roll 50 midway between its upper and lower limit positions. Thus a decrease in tension causes the dancer roll 50 to move upwardly which in turn actuates the resistor 66 to increase its resistivity. This decreases the magnitude of the signal applied to the input 77 of the controller 71 and causes the controller to retard the speed of the motor 60, thereby increasing tension on the yarns. An increase in the yarn tension, of course, produces the opposite effect. It should be noted that the resistor 66′ provides a feedback to the motor controller 71 to minimize oscillation of the dancer roll 50.

In manufacturing rope according to the present invention, the magnitude of the tension on the yarns should be controlled so that the yarns are prevented from shrinking more than about 1% due to the heat applied in the curing step. For nylon rope yarns, the tension should be at least 0.1 gram per denier, and preferably the tension should be maintained at about 0.2 gram per denier.

In view of the foregoing, it should be apparent that the present invention provides both a novel parallel yarn rope and a process for manufacturing the rope. The disclosed rope is strong; it is resistant to penetration by moisture; it possesses strong dielectric strength; and it is highly flexible. The disclosed process enables the rope to be manufactured economically. Moreover, because of the accurate tension control which is maintained during the manufacturing process, and the uniformity of tension among the rope yarns, the rope of the present invention is 15% stronger than a rope of corresponding construction which does not have such uniformity of yarn tension. The uniformity in tension is believed to be due to the fact that the yarn filaments are locked together into a compact, coherent yarn bundle during the manufacturing process.

While a preferred process for manufacturing a preferred embodiment of the present invention has been described in detail, various modifications, alterations and changes may be made without departing from the spirit and scope of the present invention as defined in the appended claims.

I claim:

1. A method of making rope, comprising the steps of: advancing lengthwise a plurality of rope yarns each composed of a series of filaments, tensioning said rope yarns as they advance to compact said filaments, coating said rope yarns with a layer of an uncured binder material as said yarns advance under tension to distribute the binder material predominantly on the surface of each rope yarn and to prevent penetration of said binder material deeply into the interior of said rope yarns and among inner ones of the filaments of each rope yarn, joining said yarns together lengthwise in parallel relation to form a core, applying a layer of an uncured binder material on said core, and heating the assembly to cure the binder materials.

2. The method according to claim 1 wherein said layer-applying step includes the step of wrapping a tape of said material helically around said core as the core advances lengthwise.

3. The method according to claim 2 including the steps of drying said coated yarns prior to said joining step, and braiding a jacket around said core after said wrapping step and prior to said curing step.

4. The method according to claim 3 including the step of advancing said jacket through a neoprene latex containing about 30%, by weight, of neoprene, and drying the neoprene-coated jacket prior to said curing step.

5. The method according to claim 3 including the steps of maintaining the temperature in said drying step below the temperature in said curing step and maintaining the temperature in said curing step at a level sufficient to cause said wrapped layer to flow among the braids of the jacket to interlock the jacket to the core while curing the same.

6. The method according to claim 5 wherein the temperature in said drying step is maintained at about 225° F and said core is subjected to said temperature for about 10 to 20 minutes, and the temperature in said curing step is maintained between about 300° to 350° F. and said assembly subjected to said curing temperature for about 15 to 45 minutes.

7. The method according to claim 5 including the step of permitting said rope to cool while advancing under tension after said curing step.

8. The method according to claim 1 including the step of controlling the tension on said yarns during said tensioning step in relation to the temperature in said curing step to prevent said yarns from shrinking more than about 1% in length during manufacture.

9. A method according to claim 8 including the step of maintaining said tension in excess of about .1 gram per denier during said tension-controlling step.

10. The method according to claim 1 wherein said tensioning step includes the steps of sensing the longitudinal velocity of said yarns at one location, and automatically controlling the longitudinal velocity of said yarns at another location ahead of said coating step location in response to changes in the velocity sensed at said one location, whereby proper tension on the yarns in accurately maintained.

11. The method according to claim 10 wherein said velocity sensing step includes the step of converting said velocity into an electrical signal proportional to said velocity, and said automatic control step including the step of regulating the velocity of said yarns at said other location in response to said signal by decreasing the velocity in response to decreases in the sensed yarn velocity and increasing the velocity in response to increases in the sensed yarn velocity.

12. The method according to claim 11 including the steps of sensing tension on said yarns at said location ahead of said coating step, converting said sensed tension into another electrical signal, and combining said electrical signals to provide an electrical control signal for effecting regulation of said yarn velocity with said control signal having a feedback component provided by the signal produced in said tension-sensing step, whereby accurate yarn tension contrl may be effected.

13. The method according to claim 1 wherein said coating step includes the step of advancing said yarns through a vat containing a neoprene latex comprising about 20% by weight of neoprene.

14. The method of claim 1 wherein each of said advancing rope yarns has a slight twist in a range of between about 4 to about 8 turns per foot.

* * * * *